US009079639B2

(12) United States Patent
Chitwood

(10) Patent No.: US 9,079,639 B2
(45) **Date of Patent: *Jul. 14, 2015**

(54) LARGE VOLUME SUBSEA CHEMICAL STORAGE AND METERING SYSTEM

(71) Applicant: Safe Marine Transfer, LLC, Houston, TX (US)

(72) Inventor: James E. Chitwood, Houston, TX (US)

(73) Assignee: Safe Marine Transfer, LLC, Houston, TX (US)

( * ) Notice: Subject to any disclaimer, the term of this patent is extended or adjusted under 35 U.S.C. 154(b) by 142 days.

This patent is subject to a terminal disclaimer.

(21) Appl. No.: 13/858,024

(22) Filed: Apr. 6, 2013

(65) Prior Publication Data

US 2014/0301790 A1 Oct. 9, 2014

(51) Int. Cl.

| | |
|---|---|
| ***B65D 88/78*** | (2006.01) |
| ***B63B 35/44*** | (2006.01) |
| ***B63B 25/12*** | (2006.01) |
| ***B63B 35/28*** | (2006.01) |
| ***B63G 8/00*** | (2006.01) |
| ***B65D 90/50*** | (2006.01) |

(52) U.S. Cl.

CPC ..... *B63B 25/12* (2013.01); *B63B 35/28* (2013.01); *B63G 8/001* (2013.01); *B65D 88/78* (2013.01); *B65D 90/50* (2013.01)

(58) Field of Classification Search

CPC ..... B65D 88/78
USPC ..... 405/210; 220/567.2
See application file for complete search history.

(56) References Cited

U.S. PATENT DOCUMENTS

| | | | | | |
|---|---|---|---|---|---|
| 2,924,350 | A | * | 2/1960 | Greer | 405/210 |
| 3,471,349 | A | * | 10/1969 | Bosworth et al. | 156/155 |
| 3,675,427 | A | | 7/1972 | Hix, Jr. | |
| 3,727,418 | A | | 4/1973 | Glazier | |
| 3,835,653 | A | | 9/1974 | Hix, Jr. | |
| 3,837,310 | A | | 9/1974 | Toyama | |
| 3,855,809 | A | | 12/1974 | Westling | |
| 3,898,846 | A | * | 8/1975 | McCabe | 405/210 |
| 4,007,700 | A | | 2/1977 | Haynes et al. | |
| 4,059,065 | A | * | 11/1977 | Clark et al. | 114/256 |
| 4,141,377 | A | * | 2/1979 | Fernandez et al. | 405/210 |

(Continued)

FOREIGN PATENT DOCUMENTS

| | | | |
|---|---|---|---|
| JP | H0710080 | A | 1/1995 |
| JP | 2008215481 | A | 9/2008 |

OTHER PUBLICATIONS

International Search Report and Written Opinion dated Sep. 4, 2014 in corresponding International application No. PCT/US2014/032994 (13 pages).

(Continued)

*Primary Examiner* — Frederick L Lagman
(74) *Attorney, Agent, or Firm* — Osha Liang LLP

(57) ABSTRACT

A liquid storage tank comprising an outer container wherein the outer container is rigid and has at least two inner containers disposed within the outer container. The first inner container contains seawater, and the second inner container contains at least one stored liquid. The at least two inner containers are flexible and pressure balanced while the volume of the outer container remains fixed, and the volumes of the at least two inner containers are variable. The liquid storage tank is provided for disposal and installation in a subsea environment.

28 Claims, 3 Drawing Sheets

(56) References Cited

U.S. PATENT DOCUMENTS

| | | | | |
|---|---|---|---|---|
| 4,190,072 | A * | 2/1980 | Fernandez et al. | 405/210 |
| 5,199,594 | A | 4/1993 | Obara et al. | |
| 5,778,679 | A * | 7/1998 | Celorier et al. | 62/47.1 |
| 6,527,002 | B1 * | 3/2003 | Szakaly | 220/567.2 |
| 6,945,187 | B1 * | 9/2005 | Woodall et al. | 114/256 |
| 7,448,404 | B2 | 11/2008 | Samuelsen et al. | |
| 7,654,279 | B2 * | 2/2010 | Horton et al. | 405/210 |
| 7,841,289 | B1 | 11/2010 | Schanz | |
| 8,387,817 | B1 | 3/2013 | Zelechonok | |
| 8,678,711 | B2 * | 3/2014 | Wu | 405/210 |
| 2012/0305411 | A1 | 12/2012 | Elazari-Volcani | |

OTHER PUBLICATIONS

Non-Final Office Action issued Feb. 9, 2015 in related U.S. Appl. No. 14/203,635 (20 pages).

* cited by examiner

LARGE VOLUME SUBSEA CHEMICAL STORAGE AND METERING SYSTEM

BACKGROUND

Many subsea petroleum production activities require the use of chemicals or mud to be added to the active operation to properly operate. Historically, these chemical provisions have been provided through hoses, tubes or pipes bundled into "umbilicals" to supply the chemicals from nearby surface facilities to the respective points of injection. Longer offsets, remote locations and deeper water depths contribute to making umbilical solutions expensive.

Existing subsea chemical storage in use today may be used for short-term single purpose use and have relative small volumes. For example, a number of bladder style chemical storage tanks have been developed for this purpose. Existing subsea chemical storage assemblies may include single wall flexible tanks or bladders that are exposed directly to sea, which may be contained within some cage or frame for protection and transportation. However, the sizes of these storage tanks are relatively small (hundreds of gallons). Additionally, the application use subsea is typically short term (days).

SUMMARY

In one aspect, embodiments of the present disclosure relate to a liquid storage tank that includes an outer container, wherein the outer container is rigid, and at least two inner containers disposed within the outer container, wherein the at least two inner containers include a first inner container containing seawater and a second inner container containing at least one stored liquid, wherein the at least two inner containers are flexible, wherein the at least two inner containers are pressure balanced, and wherein the volume of the outer container remains fixed, and the volumes of the at least two inner containers are variable.

In another aspect, embodiments of the present disclosure relate to a method of providing chemicals to a sea floor installation that includes providing a storage tank in a subsea environment, wherein the storage tank has an outer container and at least two inner containers disposed within the outer container, wherein the at least two inner containers include a first inner container containing seawater and a second inner container containing at least one chemical, wherein the at least two inner containers are flexible, wherein the at least two inner containers are pressure balanced, and wherein the volume of the outer container remains fixed, and the volumes of the at least two inner containers are variable.

This summary is provided to introduce a selection of concepts that are further described below in the detailed description. This summary is not intended to identify key or essential features of the claimed subject matter, nor is it intended to be used as an aid in limiting the scope of the claimed subject matter.

DETAILED DESCRIPTION

Embodiments of the present disclosure relate to large volume storage tanks. For example, embodiments of the present disclosure may relate to liquid storage tanks that include a rigid outer container and at least two flexible inner containers disposed within the outer container, wherein the at least two inner containers include a first inner container containing seawater and a second inner container containing at least one stored liquid, wherein the at least two inner containers are pressure balanced, and wherein the volume of the outer container remains fixed, and the volumes of the at least two inner containers are variable.

Figure 1:
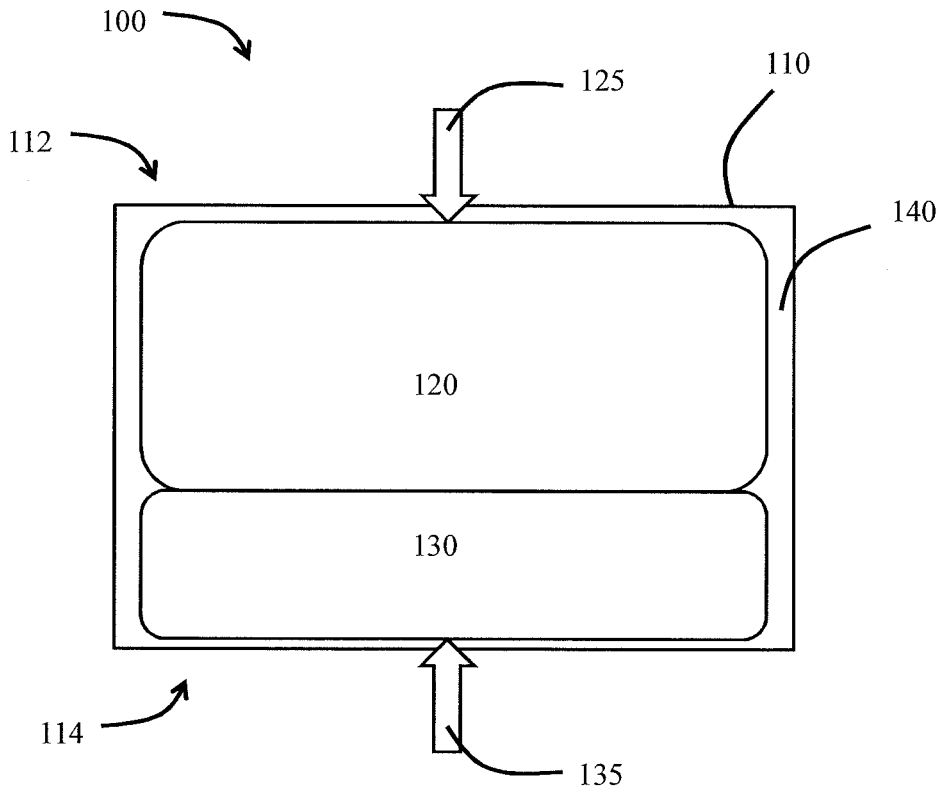
FIG. 1 shows a diagram of a storage tank according to embodiments of the present disclosure.

Referring to FIG. 1, a diagram of a liquid storage tank 100 according to embodiments of the present disclosure is shown. The storage tank 100 includes an outer container 110 and at least two inner containers 120, 130. The outer container 110 is rigid, while the inner containers 120, 130 are flexible. For example, the inner containers 120, 130 may be bladders made of a flexible, durable materials suitable for storing liquids in a subsea environment, such as polyvinyl chloride ("PVC") coated fabrics, ethylene vinyl acetate ("EVA") coated fabrics, or other polymer composites. The inner containers include a first inner container 130 containing seawater and a second inner container 120 containing at least one stored liquid. The inner containers are pressure balanced such that as the stored liquid is added or removed from the second inner container 120, a corresponding volume of seawater outflows or inflows from the first inner container 130. The inner containers 120, 130 may be equipped with closure valves that close and seal-off when the associated inner container fully collapses, which may protect the integrity of the inner containers by not subjecting the inner containers to potentially large differential pressures. Further, the outer container 110 may act as an integral secondary or backup containment vessel that would contain any leak from the inner containers, thus creating a pressure balanced dual barrier containment system. As used herein, a "dual barrier" system refers to a system where both an inner container and an outer container have to fail before there is a tank content leak or discharge to the sea environment. Monitoring of the conditions in the space 140 between the dual barriers, such as described below, may provide an indication of required repairs for a failure of a primary barrier (an inner container). Further, integral safety features may be included in the storage tank to prevent damage to the tank system in the event the tank is emptied or overfilled.

The outer container 110 may be of any shape and made of any material. For example, the outer container 110 may be a metallic construction and integrated within a larger structure. Further, the outer container 110 may be a size that is large enough to contain at least two inner containers. For example, an outer container may be large enough to contain two or more flexible inner containers that are capable of storing an amount of liquid sufficient for use for a long duration, such as between resupply operations. According to some embodiments, each of the at least two inner containers may be filled to a volume ranging up to 5,000 barrels. In such embodiments, the outer container may have a size large enough to contain the at least two inner containers. In some embodiments, each of the at least two inner containers may be filled to a volume ranging up to 3,000 barrels. In some embodiments, each of the at least two inner containers may be filled to a volume ranging up to 1,000 barrels. Further, in some embodiments, more than two flexible inner containers may be housed within a rigid outer container. For example, six or more flexible inner containers that may each be filled to a volume of up to 1,000 barrels may be housed within a rigid outer container. Other amounts of flexible inner containers, each capable of storing large amounts of liquid, may be contained within a rigid outer container. Further, at least two inner containers of the present disclosure may be capable of storing equal volumes of liquid, or at least two inner containers housed within an outer container may be capable of storing different volumes of liquid. For example, an outer container may contain at least three inner containers, wherein a first inner container is capable of storing a larger volume of liquid than the at least two other inner containers, and wherein the at least two other inner containers may be connected together in series or in parallel to achieve a total working volume. It is within the scope of this disclosure that two or more inner containers may be connected together in series or in parallel to achieve a desired working volume. Further, according to some embodiments, two or more rigid outer containers may be connected together to become part of a multi-unit structure. For example, a barge having multiple separate holds may form a multi-unit structure, wherein each hold forms a rigid outer container of the present disclosure connected to each other.

Further, the volume of the outer container 110 remains fixed, and the volumes of the at least two inner containers 120, 130 are variable. For example, while the stored liquid may be added or removed from the second inner container 120 through a controlled opening 125 (and increase or decrease the respective volume of the second inner container 120) and a corresponding volume of seawater may outflow or inflow from the first inner container 130 through a controlled opening 135 (and decrease or increase the respective volume of the first inner container 130), the size and volume of the rigid outer container 110 remains fixed. A barrier fluid may be disposed between the annular space 140 between the outer container 110 and the inner containers 120, 130. The barrier fluid may be monitored for contamination, such as contamination from a leak in one of the inner containers. For example, the barrier fluid may be monitored by disposing sensors within the annular space 140 between the outer container 110 and the inner containers 120, 130, or barrier fluid samples may be periodically collected and analyzed on a periodic basis. According to embodiments of the present disclosure, a storage tank may include at least one sensor disposed in the space between the outer container and the at least two inner containers. Sensors may be used in the storage tank, for example, to monitor contamination of the barrier fluid, as discussed above, to monitor the volumes of the at least two inner containers, to monitor temperature and/or pressure conditions, or to monitor other conditions of the storage tank.

According to embodiments of the present disclosure, the active volume of fluid in each inner container may be monitored by measuring the inner container's relative location to either the topside 112 or bottom side 114 of the outer container 110. As used herein, "topside" may refer to the side of the referenced component that faces the seawater surface when the component is installed at the sea floor, and "bottom side" may refer to the side of the referenced component that faces the sea floor when the component is installed at the sea floor. In some embodiments, monitoring the active volume of each inner container may be achieved by monitoring the inflow and outflow of the respective inner containers, which may help assure integrity of the storage system as well as provide an indication of the chemical dosing performed from the storage system.

At least one inner container may be filled with a liquid including at least one of chemicals, fuel, hydrocarbons, and muds. As used herein, a "stored liquid" or a "liquid" may refer to liquids other than seawater or gases. For example, various liquids or gases that may be stored in at least one inner container of the present disclosure may include chemicals expected to be used in subsea production, such as methanol, glycol, diesel, oil, antiagglomerate hydrate inhibitors, Low Dosage hydrate Inhibitors, slops, muds and many other possible liquids or gases. Further, liquids that may be stored in the flexible inner container(s) may include those capable of functioning in deepsea hydrostatic pressure (up to 5,000 psi) and cold deepsea temperature (~34° F.), while also maintaining the flexibility of the inner container.

Liquids stored in inner containers of the present disclosure may have a lower density than the surrounding seawater or may have a higher density than the surrounding seawater. For example, the density of a stored liquid that includes drilling mud may vary from a specific gravity of about 0.8 to about 2.0. In embodiments having a second inner container that stores a liquid with a density lower than the seawater filling a first inner container, the second inner container may be stacked on top of the first inner container. In embodiments having a second inner container that stores a liquid with a density higher than the seawater filling a first inner container, the first inner container may be stacked on top of the second inner container. For example, as shown in FIG. 1, the first inner container 130 may include seawater, and the second inner container 120 may include a stored liquid that has a density lower than the seawater stored in the first inner container 130, and thus the second inner container 120 is stacked over the first inner container 130.

According to embodiments of the present disclosure, a metering system may connect an inner container having a stored liquid therein to a subsea point of consumption. For example, as shown in FIG. 1, a metering system may be connected to a controlled opening 125 (e.g., which may function as an inlet or outlet, depending on whether liquid is being injected into a production system or collected) into the second inner container 120 containing a stored liquid, such as one or more chemicals. The metering system may be used to control the flow of the stored liquid into or out of the second inner container 120. In some embodiments, the pressure of a stored liquid may be elevated (with a metering pump) above hydrostatic pressure of the surrounding seawater for injection into an active production system. In some embodiments, a production system may be operating below hydrostatic pressure and the sea's environmental pressure may force the stored liquid from a storage tank of the present disclosure and into the production system. Further, the rate of chemical dosing or liquid injection may be controlled. For example, in some embodiments, a stored liquid may be used sparingly in a production system and dosed at a low rate with a small metering pump, while another stored liquid, such as methanol, may be dosed in large volumes and at high rates into the production system. The piping and pumping systems used in conjunction with stored liquid injection into a production system may be sized according to the volumes and rates of the liquid being dosed.

Storage tanks of the present disclosure may have at least one inner container maintained with a stored liquid. At least one inner container of a storage tank may be refilled with a liquid by refilling the tank on the seafloor from a surface vessel or by replacing the empty tank and refilling it onshore. For example, according to embodiments of the present disclosure, a method of providing liquid (e.g., chemicals) to a sea floor installation may include providing a storage tank in a subsea environment, wherein the storage tank has an outer container and at least two flexible inner containers disposed within the outer container, including a first inner container containing seawater and a second inner container containing at least one stored liquid, wherein the at least two inner containers are pressure balanced, and wherein the volume of the outer container remains fixed, and the volumes of the at least two inner containers are variable. The liquid may be, for example, injected into a wellbore through a controlled opening, such as an outflow valve, in the second inner container, provided through a downline from the seaborne vessel to the second inner container of the storage tank, or refilled into the second inner container after the storage tank has been hoisted from the sea.

Figure 2:
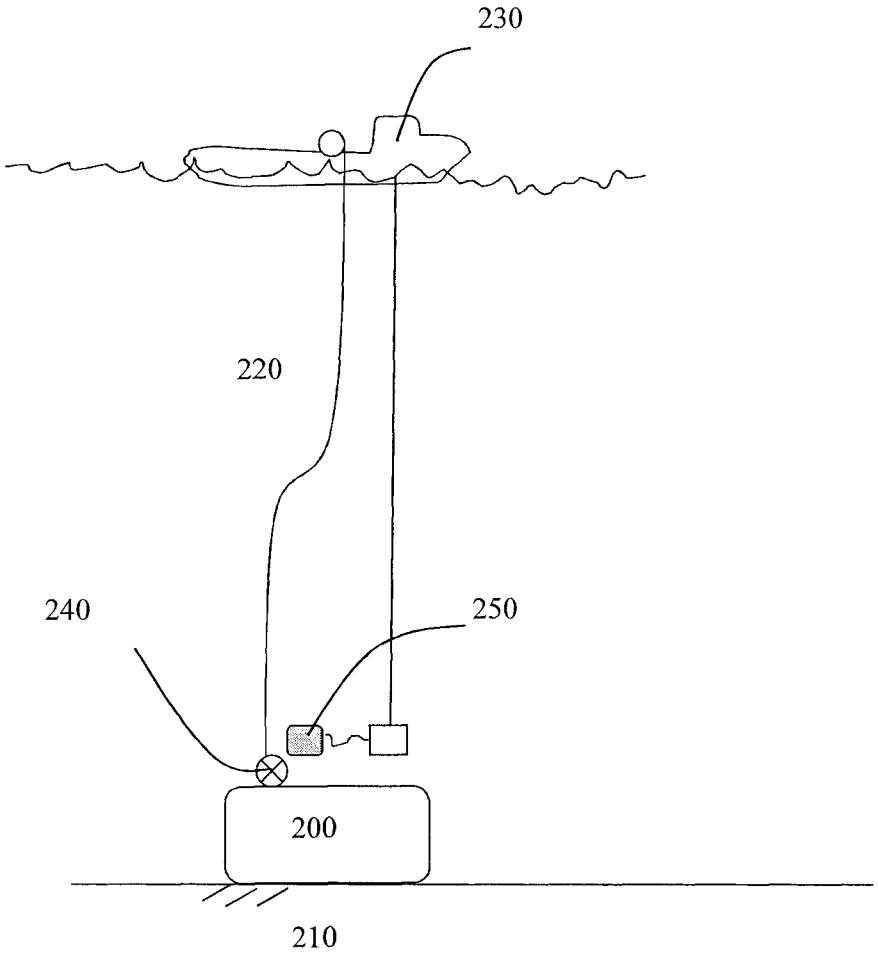
FIG. 2 shows a diagram of a storage tank installed at the seafloor according to embodiments of the present disclosure.

Referring now to FIG. 2, a storage tank 200 according to embodiments of the present disclosure is at a sea floor 210. The storage tank 200 has at least two flexible inner containers (not shown), wherein a first inner container contains seawater and a second inner container contains a stored liquid including at least one chemical. The at least one chemical may be injected into a wellbore through an outflow valve in the second inner container, wherein as the volume of the at least one chemical in the second inner container decreases, seawater from the subsea environment flows through an inflow valve in the first inner container to increase the volume of seawater in the first inner container. The at least one chemical may be refilled into the second inner container according to methods described herein.

For example, a downline 220 may be provided from a seaborne vessel 230 to the second inner container, wherein the downline includes a refill nozzle 240 connecting the downline 220 to the storage tank 200 and a pressure control valve positioned at the refill nozzle 240. The pressure control valve may control the downline outlet pressure to a maximum differential over the ambient hydrostatic pressure from the surrounding subsea environment. By controlling the downline outlet pressure to a maximum differential over the ambient hydrostatic pressure, the pressure control valve may prevent over-pressurization of the storage tank during refill operations. For example, the pressure control valve may control the downline outlet pressure to a differential pressure of less than about 20 psi, and less than 10 psi in some embodiments.

Referring still to FIG. 2, at least one remotely operated vehicle ("ROV") 250 may be used to perform subsea operations on the storage tank 200. As shown, an ROV 250 may be tethered to the seaborne vessel 230. The ROV 250 may be used, for example, to connect the initial injection hoses and any power and command links to the subsea production system or to connect a downline 220 to the storage tank 200 for refilling applications. In some embodiments, two ROVs may be used to perform subsea operations.

Figure 3:
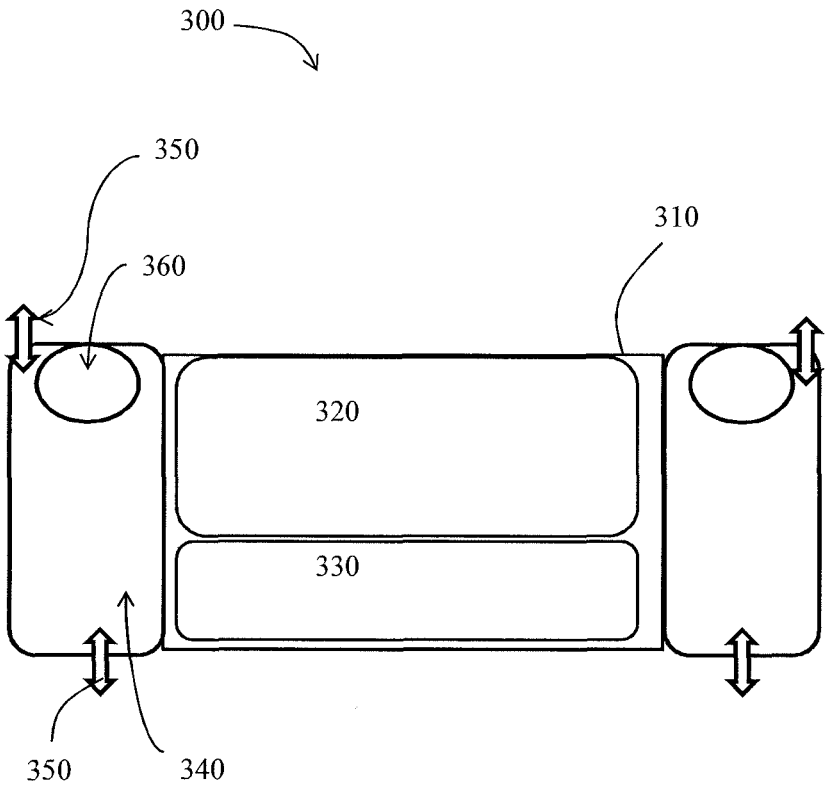
FIG. 3 shows a diagram of a storage tank according to embodiments of the present disclosure.

According to embodiments of the present disclosure, a method of providing a storage tank to the sea floor may include lowering the storage tank to the sea floor using at least one variable buoyancy chamber disposed along at least one wall of the storage tank. For example, referring to FIG. 3, a storage tank 300 according to embodiments of the present disclosure may include an outer container 310, at least two flexible inner containers 320, 330 disposed within the outer container 310, and at least one variable buoyancy chamber 340 disposed along at least one wall of the outer container 310, wherein each variable buoyancy chamber 340 has at least one inflow outflow valve 350. The at least two flexible inner containers 320, 330 include a first inner container 330 (for holding seawater) and a second inner container 320 (for holding at least one stored liquid). In some embodiments, at least one variable buoyancy chamber may be disposed along a topside of the outer container of a storage tank, wherein the at least one variable buoyancy chamber is filled with pressurized air. The storage tank may then be lowered to the sea floor by releasing pressurized air from the variable buoyancy chamber and flowing seawater through the at least one inflow outflow valve into the variable buoyancy chamber. According to embodiments of the present disclosure, a storage tank 300 may also include at least one fixed buoyancy chamber 360. The at least one fixed buoyancy chamber 360 may be rated for the hydrostatic working depth of the storage tank 300. The amount of fixed buoyancy, e.g., the relative volume of the at least one fixed buoyancy chamber 360 to the storage tank 300, may control the submerged weight in the lowering line processes.

Further, storage tanks of the present disclosure may be floated at the surface of the sea for towing to and from the shore. For example, according to embodiments of the present disclosure, a storage tank may be larger than 3,000 barrels, larger than 5,000 barrels in some embodiments, and larger than 8,000 barrels in yet other embodiments. The storage tank may contain volumes in the disclosed ranges using either a single flexible second inner container (for holding the stored liquid), or multiple flexible second inner containers connected together in series or in parallel to achieve the desired total working volume. Further, as described above, a storage tank of the present disclosure may include one rigid outer container (holding at least two flexible inner containers) or multiple rigid outer containers (each holding at least two flexible inner containers) connected to each other. The total volume of the storage tank (including the rigid outer container and at least two flexible inner containers) may range from greater than 3,000 barrels to a volume small enough to fit under a hoisting device and/or small enough for ROVs to maneuver the structure into its desired location on the seafloor. Such storage tanks may also have a high weight, and thus, support vessels may have inadequate crane capacity to lift the storage tank into or from the water. According to embodiments of the present disclosure, a storage tank may be hoisted towards the surface of the sea from the sea floor by releasing the water from the buoyancy chambers to float the storage tank.

According to embodiments of the present disclosure, a storage tank may be shaped to act as a barge or other seaborne vessel with an internal cargo hold containing at least two flexible inner containers. The storage tank may include a bow for towing and/or double-sided walls to minimize consequences if a collision occurs during towing. Double-sided walls of a storage tank may also be used for buoyancy in floating the storage tank during towing and transit, which may subsequently be flooded when the tank is fully submersed. Further, in some embodiments, a storage tank shaped as a seaborne vessel may be subdivided into smaller compartments for containing and segregating multiple flexible inner containers filled with at least one type of chemical or for greater chemical storage volume.

The amount of rigging used to transition from a storage tank towing bridle to a rigging used to lower the storage tank to the seafloor on an active heave compensated lift line may be minimized. For example, a hinged towing bridle may be used at the bow of a storage tank. In some embodiments, a post may be braced at the center of a storage tank wherein the post has a connection profile on top of the post (at the end most distal from the storage tank) for a rapid connect/ROV release connector for attachment of the lifting line suspended from a workboat crane. A towing vessel may pull the storage tank alongside the crane equipped workboat (i.e., a two vessel operation), wherein the crane is attached to the top of the post for tank submergence and lowering to the seafloor.

As discussed above, high pressure buoyancy may be disposed along the topside of a storage tank according to embodiments of the present disclosure. By adding buoyancy chambers along the topside of a storage tank, the buoyancy may be provided above the center of gravity of the storage tank, and thus, the load may be stable when suspended from a lift line. The buoyancy chambers may reduce the submerged weight of the storage tank system such that a readily available crane or winch on a workboat with an ROV may be capable of lowering the tank to the seafloor, positioning and hooking up the storage tank system. The crane or winch used to maneuver the storage tank may be actively motion compensated to minimize the added mass loads due to the support vessel heaving. Buoyancy chambers may be provided in various forms. For example, fixed solid buoyancy rated for the working depth or a composite pipe capped and securely racked at the top of the storage tank may be used. The buoyancy pipe may be sized (diameter and wall thickness) to appropriately resist collapse pressures at the storage tank's operating depth while also providing the required amount of buoyancy. A buoyancy pipe may also be used as a compressed air storage volume. For example, once a storage tank is lifted from the seafloor to a near-surface location (e.g., during a storage tank replacement operation) the air from the buoyancy pipe may be released into the variable buoyancy spaces within the structure of the storage tank to deballast these spaces and prepare the storage tank for surface towing. Using a fixed buoyancy pipe as compressed air storage may eliminate the need to connect an air hose or a water pump to deballast the sidewall tanks upon its return to surface.

Further, a storage tank may be fitted with piping and compartments to house and protect the chemical injection pump and meter components that route the chemicals (or other liquid other than seawater) through high pressure hoses or tubes to their injection points. In some embodiments, the injection pump and related components may be returned with the storage tank, and thus may be routinely maintained along with the storage tank. In some embodiments, the injection pump and metering components may be separately located on a module that is independently maintained.

Depending upon the chemical dosing rate and the application, both the piping and injection pump may be appropriately sized, or if the chemical (or other liquid) injection is into a sub-hydrostatic environment, then a throttling valve and metering system may also be used. A control pod may control injection pumps and to monitor any sensors monitoring the operation of the storage tank and the metering system. The control pod may interface into the production control system using standard protocols. Further, a flying lead for power, data and command communications may be deployed from the storage tank to the subsea electrical connection point. The control pod, pump and metering system may be located onboard the storage tank or it may be separately positioned in the production system. Lockers for flying leads (both electrical and chemical) may be located on the storage tank, which may manage the flying leads during tank deployment and recovery. A locker may be optimized for ROV operation. A flying lead deployment mechanism may also facilitate the efficient recovery of flying leads in the event the storage tank is changed out.

Storage tanks of the present disclosure may be ballasted to sink below the surface of the sea, which in some cases, may include submersing the storage tank below waves at the sea surface. According to some embodiments, columns may be attached to each corner of a storage tank. Columns may vary in size and shape, but may include, for example a height ranging from 10 to 15 feet. The columns may provide semisubmersible performance and motion control during ballast down operations until the tops of the columns submerge, which may also provide for storage tank stability in the near surface wave environment.

Seafloor environments may vary, for example, the seafloor may be firm and compacted (on which a storage tank may be directly placed), or the seafloor may be soft (on which a storage tank may be placed on an intermediate foundation placed on the seafloor, such as a concrete mudmat). According to embodiments of the present disclosure, a suction pile foundation may be installed on the seafloor and then a storage tank of the present disclosure may be placed on the suction pile foundation. A suction pile foundation may provide hard spot landing points that are suitably reinforced to support the weight of the storage tank system. A foundation may also feature alignment posts (e.g., having at least two different heights) to capture matching funnels and sleeves built into a storage tank. The posts and funnels may assure proper location, alignment and orientation of the storage tank with respect to the rest of the subsea production system and equipment. A storage tank of the present disclosure may be maneuvered using a combination of the surface vessel positioning and the monitoring and maneuvering provided by at least one ROV. Further, there may be some constraints imposed by higher seafloor currents (and available ROV power), and thus, landing the storage tank may depend upon performing the operation during the cyclic low current time periods.

According to some embodiments, a skirt may be added to the bottom side of the storage tank to prevent its shifting. The skirt may be segregated into sections with piping to the topside of the storage tank, which may enable an ROV to dock and pump water into the skirt spaces under the storage tank to minimize any suction loads as the storage tank is lifted from the seafloor during a change-out operation.

Although only a few example embodiments have been described in detail above, those skilled in the art will readily appreciate that many modifications are possible in the example embodiments without materially departing from embodiments disclosed herein. Accordingly, all such modifications are intended to be included within the scope of this disclosure as defined in the following claims.

What is claimed:

1. A liquid storage tank, comprising:

an outer container, wherein the outer container is rigid;

at least two inner containers disposed within the outer container, the at least two inner containers comprising:

a first inner container containing seawater; and a second inner container containing at least one stored liquid;

wherein the at least two inner containers are flexible;

a barrier fluid disposed in the space between the at least two inner containers and the outer container;

wherein the at least two inner containers are pressure balanced; and wherein the volume of the outer container remains fixed, and the volumes of the at least two inner containers are variable.

2. The storage tank of claim 1, wherein the stored liquid comprises at least one of chemicals, fuel, hydrocarbons, and muds.

3. The storage tank of claim 1, wherein each of the at least two inner containers may be filled to a volume ranging up to 5,000 barrels.

4. The storage tank of claim 1, further comprising a metering system connecting the second inner container of stored liquid to a subsea point of consumption.

5. The storage tank of claim 1, wherein the at least two inner containers comprises more than two inner containers.

6. The storage tank of claim 1, wherein the at least one stored liquid is denser than the seawater.

7. The storage tank of claim 1, wherein the at least one stored liquid is less dense than the seawater.

8. The storage tank of claim 1, further comprising at least one buoyancy chamber along a topside of the outer container, wherein the at least one buoyancy chamber comprises pressurized air.

9. The storage tank of claim 1, further comprising at least one sensor disposed in the annular space between the outer container and the at least two inner containers.

10. A method of providing chemicals to a sea floor installation, comprising:

providing a storage tank in a subsea environment, the storage tank comprising:

an outer container;

at least two inner containers disposed within the outer container, the at least two inner containers comprising:

a first inner container containing seawater; and a second inner container containing at least one chemical;

wherein the at least two inner containers are flexible; and wherein the at least two inner containers are pressure balanced;

wherein the volume of the outer container remains fixed, and the volumes of the at least two inner containers are variable;

injecting the at least one chemical at a subsea point of consumption through an outflow valve in the second inner container;

wherein as the volume of the at least one chemical in the second inner container decreases, seawater from the subsea environment flows through an inflow valve in the first inner container to increase the volume of seawater in the first inner container.

11. The method of claim 10, further comprising refilling the second inner container with at least one chemical.

12. The method of claim 11, wherein the refilling comprises:

providing a downline from a seaborne vessel to the second inner container, wherein the downline comprises:

a refill nozzle connecting the downline to the storage tank; and a pressure control valve positioned at the refill nozzle;

wherein the pressure control valve controls the downline outlet pressure to a maximum differential over the ambient hydrostatic pressure from the surrounding subsea environment.

13. The method of claim 10, further comprising:

lowering the storage tank to the sea floor, wherein the storage tank further comprises fixed and variable buoyancy chambers disposed along at least one wall of the outer container, each variable buoyancy chamber comprising at least one water inlet, and wherein the lowering comprises:

flowing water into the at least one water inlet.

14. The method of claim 13, further comprising:

hoisting the storage tank towards the surface of the sea;

floating the storage tank, wherein floating comprises releasing the water from the variable buoyancy chambers.

15. The method of claim 14, further comprising towing the floating storage tank on the sea surface.

16. The method of claim 14, further comprising lifting the floating storage tank onto a seaborne vessel.

17. A liquid storage tank, comprising:

an outer container, wherein the outer container is rigid;

at least two inner containers disposed within the outer container, the at least two inner containers comprising:

a first inner container containing seawater; and a second inner container containing at least one stored liquid;

wherein the at least two inner containers are flexible;

at least one sensor disposed in the annular space between the outer container and the at least two inner containers;

wherein the at least two inner containers are pressure balanced; and wherein the volume of the outer container remains fixed, and the volumes of the at least two inner containers are variable.

18. The storage tank of claim 17, wherein the stored liquid comprises at least one of chemicals, fuel, hydrocarbons, and muds.

19. The storage tank of claim 17, wherein each of the at least two inner containers may be filled to a volume ranging up to 5,000 barrels.

20. The storage tank of claim 17, further comprising a metering system connecting the second firmer container of stored liquid to a subsea point of consumption.

21. The storage tank of claim 17, wherein the at least two inner containers comprises more than two inner containers.

22. The storage tank of claim 17, wherein the at least one stored liquid is denser than the seawater.

23. The storage tank of claim 17, wherein the at least one stored liquid is less dense than the seawater.

24. The storage tank of claim 17, further comprising at least one buoyancy chamber along a topside of the outer container, wherein the at least one buoyancy chamber comprises pressurized air.

25. A method of providing chemicals to a sea floor installation, comprising:

providing a storage tank in a subsea environment, the storage tank comprising:

an outer container;

at least two inner containers disposed within the outer container, the at least two inner containers comprising:

a first inner container containing seawater; and a second inner container containing at least one chemical;

wherein the at least two inner containers are flexible; and wherein the at least two inner containers are pressure balanced;

wherein the volume of the outer container remains fixed, and the volumes of the at least two inner containers are variable;

lowering the storage tank to the sea floor, wherein the storage tank further comprises fixed and variable buoyancy chambers disposed along at least one wall of the outer container, each variable buoyancy chamber comprising at least one water inlet, and wherein the lowering comprises:

flowing water into the at least one water inlet.

26. The method of claim 25, further comprising:

hoisting the storage tank towards the surface of the sea;

floating the storage tank, wherein floating comprises releasing the water from the variable buoyancy chambers.

27. The method of claim 26, further comprising towing the floating storage tank on the sea surface.

28. The method of claim 26, further comprising lifting the floating storage tank onto a seaborne vessel.

* * * * *